US005201158A

United States Patent [19]

Bayley et al.

[11] Patent Number: 5,201,158

[45] Date of Patent: Apr. 13, 1993

[54] METAL SHEETING

[75] Inventors: Michael J. Bayley, Bugkinghamshire; Peter G. Buxton, Buckinghamshire; Tarlochan S. Saini, Berkshire, all of England

[73] Assignee: British Alcan Aluminium plc, Gerrards Cross, England

[21] Appl. No.: 624,468

[22] Filed: Dec. 6, 1990

Related U.S. Application Data

[63] Continuation of Ser. No. 355,021, May 22, 1989, abandoned.

[30] Foreign Application Priority Data

May 13, 1988 [GB] United Kingdom ..... 8811397

[51] Int. Cl.[5] ..... E04D 3/361

[52] U.S. Cl. ..... 52/537; 52/521; 52/530; 52/542

[58] Field of Search ..... 52/528, 529, 537, 542, 52/588, 521, 519, 520, 530, 537, 538

[56] References Cited

U.S. PATENT DOCUMENTS

| | | | |
|---|---|---|---|
| 1,292,960 | 1/1918 | Owens | 52/528 |
| 1,329,794 | 2/1920 | Moomaw | 52/537 |
| 3,128,851 | 4/1964 | Deridder et al. | 52/588 |
| 3,131,794 | 5/1964 | Bender | 52/588 |
| 3,394,524 | 7/1968 | Howarth . | |
| 3,511,011 | 5/1970 | Straus . | |
| 4,266,385 | 5/1981 | Oehlert | 52/521 |
| 4,423,581 | 1/1984 | Miller | 52/542 X |
| 4,601,135 | 7/1986 | Ellis et al. | 52/529 X |
| 4,715,157 | 12/1987 | Funaki | 52/529 |
| 4,759,167 | 7/1988 | Getoor et al. | 52/528 |

FOREIGN PATENT DOCUMENTS

| | | |
|---|---|---|
| 2136584 | 7/1971 | Fed. Rep. of Germany . |
| 817238 | 6/1957 | United Kingdom . |
| 899446 | 9/1960 | United Kingdom . |

*Primary Examiner*—Michael Safavi
*Attorney, Agent, or Firm*—Browdy and Neimark

[57] ABSTRACT

A metal sheet (1) having a first upstanding hook formation (3) along one edge (2) and a second, upstanding hook receiving formation (6) and a valley (7) along an opposite edge (5) the arrangement being such that the sheet can be fastened directly to a support without the interposition of separate clips and so that the first formation of one sheet can hook over the second formation of an adjoining sheet and cover its valley characterized by latching means (11, 12, 13, 14, 15 and 16*b*, 17, 19, 21) acting between the formations so that after interlocking the sheets said one sheet can be rotated about the hook receiving formation of the other sheet through at least 25° before the formations can be disengaged.

1 Claim, 1 Drawing Sheet

METAL SHEETING

This application is a continuation of application Ser. No. 07/355,021, filed May 22, 1989 now abandoned.

FIELD OF THE INVENTION

This invention relates to metal sheeting.

DESCRIPTION OF THE PRIOR ART

Metal profiled sheets are frequently used as roof panels and for other building cladding purposes. It is well known to provide a metal sheet which is pre-formed with integral ribbing so that it may readily be interlocked at adjoining edges with a similar sheet and which may be fastened to a support without the fastening means being exposed to the environment or being on the visible side of the sheet. These products may include separate fixing clips and involve on site roll forming to close the interlocking seams. All such products are usually referred to as "raised seam cladding". Many examples of such profiled sheets are known and they are frequently roll-formed from an aluminium alloy as well as other metallic materials. Usually each sheet has a first upstanding hook formation along one edge and a second upstanding formation along an opposite edge of the sheet with a hook receiving part and a valley in the plane of the sheet through which fasteners can be passed. When the sheets are interlocked the first formation of one sheet hooks on to the hook receiving part of an adjoining sheet and covers the valley and its fasteners. From their outer surfaces the sheets then present a generally flat appearance having spaced apart upstanding ribs with no fasteners visible. These ribs are usually referred to as "raised seams".

In general, when used as roof panels, the sheets need to be fully supported on a pre-prepared flat surface and are not strong enough to span any worthwhile distance between supporting purlins. It is however clearly desirable to provide sheets that can be supported at intervals, as between spaced apart purlins, and it is further desirable that the sheet should be wider so that the spacing between the raised seams is increased. In addition the sheets should be strong enough to support snow loads, wind loads both in pressure and suction and so that, for example, operatives can walk on them.

SUMMARY OF THE INVENTION

We have found that there are conflicting factors between, on the one hand, increasing the strength and stiffness of the sheet and, on the other hand, ensuring adequate locking against suction forces under high wind conditions.

It is therefore an object of the present invention to provide an improved interlocking metal sheet which has good strength characteristics and improved interlocking formations.

According to the present invention there is provided a metal sheet having a first upstanding hook formation along one edge and a second, upstanding hook receiving formation and a valley along an opposite edge, the arrangement being such that the sheet can be fastened directly to a support without the interposition of separate clips and so that the first formation of one sheet can hook over the second formation of an adjoining sheet and cover its valley, this arrangement being characterised by latching means acting between the formations so that, after interlocking the sheets, said one sheet can be rotated about the hook receiving formation of the other sheet through at least 25° before the formations can be disengaged.

The rotation preferably occurs without significant distortion of the material of either sheet.

Preferably upon said relative rotation the latching action ceases to function, and further rotation, through at least 10° is required before the formations can be disengaged.

DESCRIPTION OF PREFERRED EMBODIMENTS

Figure 1:
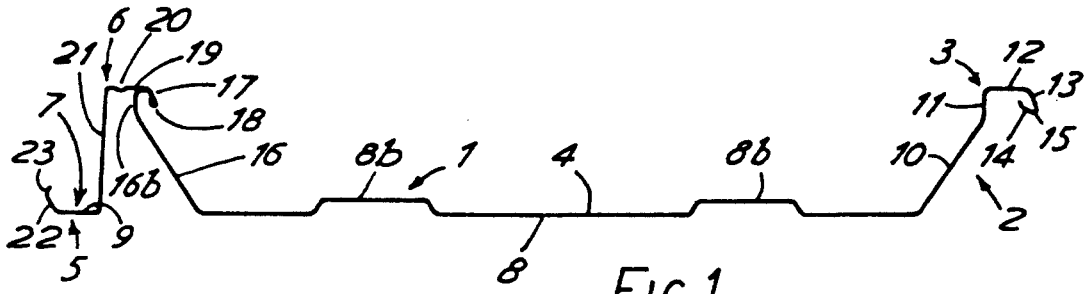
FIG. 1 is a transverse section through a metal sheet.

Referring to FIG. 1 a roll-formed aluminium alloy sheet 1 has along one side edge 2 a first hook formation indicated generally at 3 which is upstanding from the outer surface 4 of the sheet. At its other side edge 5 the sheet has a second, or hook receiving, formation indicated generally at 6 and a valley 7. The formations 3 and 6 are separated by a web 8 which is coplanar with the floor 9 of the valley 7. A number of stiffening ribs 8*b* may be formed in the sheet.

The hook formation 3 comprises an upwardly and outwardly sloping part 10, a wall 11 approximately at right angles to the web 8, a flat 12, a downwardly and outwardly projecting part 13 and an upwardly and inwardly projecting part 14, the parts 13 and 14 constituting a hook having a curved part 15. As shown the outer end of the part 14 is curved to be approximately parallel with the wall 11 and to allow run-out on the edge of the sheet material on roll forming.

The hook receiving formation 6 comprises an upwardly and outwardly sloping part 16 the upper end 16*b* of which is approximately at right angles to the web 8 and is then folded at a part 17 which, together with the wall 16*b* defines a hook receiving formation as will be described later. The lower end of the folded part 17 is formed as a hollow bead 18 and the rolled material of the sheet is then formed as a platform 19 with a recess 20, a side wall 21 approximately at right angles to the web 8 leading to the valley 7, the floor 9 of which has an upwardly turned part 22 and a lip 23 at the same angle to the web 8 as the sloping part 10. The lip 23 allows run out of the edge of the sheet material on roll forming.

Figure 3:
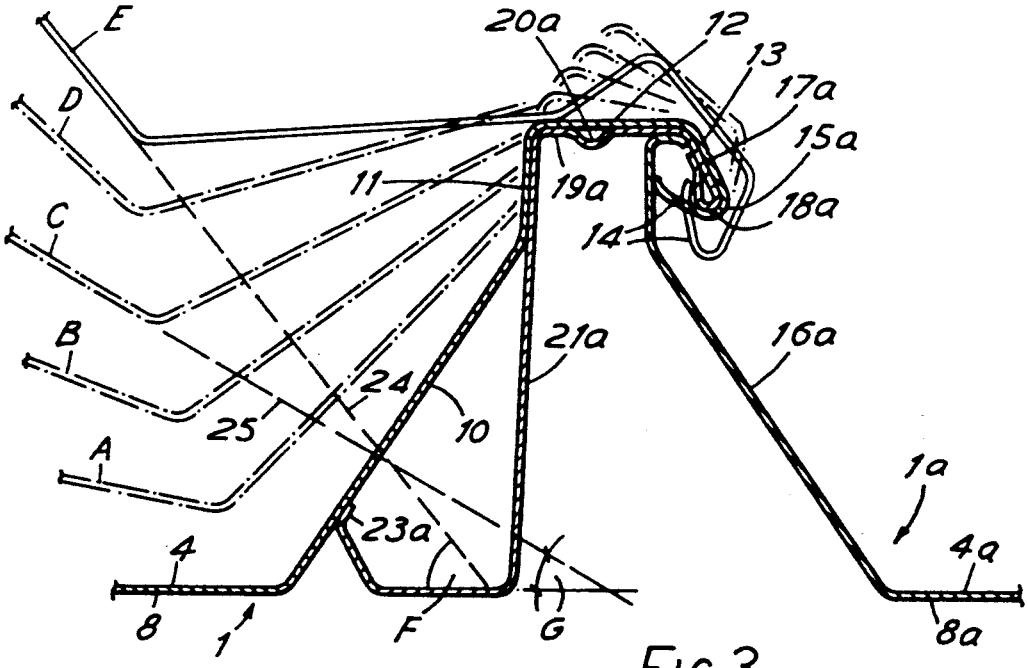
FIG. 3 is a similar section, to a larger scale, of an interconnection between two metal sheets.

FIG. 3 shows how the hook formation 3 engages over the hook receiving part 6 of an adjoining sheet. In FIG. 3 the same reference numerals have been used except that for the "adjoining" sheet suffixes "a" have been added to each reference numeral.

It will be assumed that the sheet 1*a* is already mounted on suitably spaced-apart purlins (not shown) and secured thereto through the valley floor 9*a*. The fixings used can be conventional and may be arranged to accommodate longitudinal expansion of the sheet 1*a*. The sheet 1 is then held with its web 8 approximately vertical and its hook formation 3 engaged around the bead 18*a*. The sheet 1 is then pivoted through sections D-A- to the final latched position shown in cross-hatched lines in FIG. 3. In the final latched position, in which the sheet is secured to the purlins, the sloping part 10 engages with the lip 23*a* and the wall 11, the flat 12, the part 13 and the curved part 15 respectively embrace the upper part of the side wall 21*a*, the platform 19*a*, the part 17*a* and the curved part 15*a*. Sealing material (not shown) may be disposed in the recess 20*a*. The dimensions of the formations 3 and 6 are such that the upper part of the formation 3 is a "latching fit" over the upper part of the formation 6.

As mentioned above we have found that conflicting requirements exist in increasing the strength of the sheets without at the same time increasing the risk that suction forces under high wind conditions will tear off one of the sheets. When the sheets are mounted on spaced-apart purlins this reduces the number of edge fastenings that can be used.

Although innately higher strength aluminium alloys than are usually employed can be used, this does not of itself increase the strength of the sheets sufficiently. Increasing the height of the "raised seams" constituted by the formations 3 and 6 does significantly increase the strength of the sheets and enables them to be unsupported across suitably spaced purlins. However such a change significantly alters the pattern of distortion of the "other" sheet 1*a* raised by suction forces on the web 8*a* resulting from wind flow across the outer surfaces 4 and 4*a* of the sheets. This change tends to make easier the lateral separation of the formations.

Figure 2:
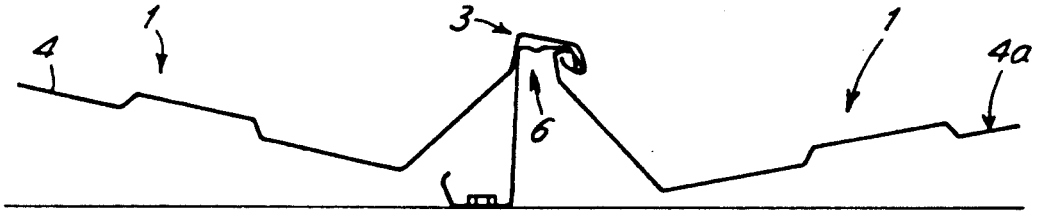
FIG. 2 is a view similar to FIG. 1 showing part of two sheets distorted by suction forces.

As shown in FIG. 2, wind flow across the outer surfaces 4 and 4*a* can cause high suction forces to be applied to the webs of the sheets and lift these webs so that their formations 3 and 6 distort and move laterally to disengage the formations 3 and 6.

With the present invention the close "latching fit" engagement between the upper parts of the formations ensures that the wall 11 constitutes latching means for the hook by its close fit against the upper part of the side wall 21*a*. As shown in FIG. 3 the edge of the sheet 1 can rotate about the bead 18*a* through successive positions indicated at A, B, C and D before reaching the position E shown as a solid line. During the movement A to approximately C the wall 11 rides up the side wall 21*a* and retains its latching action. At the approximate position C the corner between the sloping part 10 and the wall 11 rides over the corner between the side wall 21*a* and the platform 19*a*. As a result of the "latching fit" referred to above this transition occurs suddenly. In positions D and E the hook still remains engaged since the outer end of the part 14 remains in engagement with a part of the bead 18*a* which extends parallel with the upper end of the sloping part 16. Once a sheet has been distorted to the extent represented in position E the strains to which it is subjected are extremely complex and not readily predictable. However it would be expected that position E represents the point at which the edge of the sheet 1 will move laterally and the formations will disengage.

In position C the chain line 25 represents the angle between the edge of the web 8 and the line of the web 8*a*. The angle defined is G.

In position E the chain line 24 represents the angle between the edge of the web 8 and the line of the web 8*a*. The angle defined is F. The precise angle F reached for position E is determined by the detailed dimensions of the upper parts of the formations 3 and 6, the width of the web 8 and the thickness of the sheet. We have found the following criteria achieve good results:

Height of the formations 3 and 6 is a minimum of 10% (preferably 12.5%) of the total sheet width. This is to achieve a basic stiffness to the whole profile so as to allow it to support the imposed loads.

Length of the vertical wall 11 is between 20% to 30% (preferably 24%) of the height of the rib formation 3 and 6.

Center of radius of tip of the hook receiving formation is in the range 10 to 20% (preferably 14%) below the top of the rib formation 6.

Distance of center of radius of tip of hook receiving formation to vertical wall 11 when assembled is in the range 3.75% to 6.25% (preferably 5%) of the total formation width.

Sheet thickness lies in the range 0.15% to 0.25% of the total formation width.

The angle G is in the range 25° to 30° (preferably 28°).

The angle F is in the range 10° to 35° greater than angle G (preferably 30°).

By using a high strength aluminium alloy such as 3105 or 3004 in standard roofing sheet thicknesses and tempers and by increasing the height of the raised seams, the basic strength of sheets 500 mm wide can be increased sufficiently to enable the sheets to span purlins with spacings in excess of 2.0 m and still readily support snow and wind loads both in pressure and suction and carry the weight of an operative between the purlins. By utilising the latching feature of the present invention the disadvantages of increasing the height of the seams can be obviated and increased protection given against suction induced by wind force.

It will be understood that with the interlocking formations described above then should the sheet 1 be rotated through an angle significantly greater than the angle F (position E) the sheets will again interlock as the part 14 extends upwardly behind the folded part 17. Depending upon the dimensions of these parts this reengagement is likely to occur with an angle F of about 75°.

We claim:

1. A profiled metal sheet for use as a roof panel and for building cladding purposes, comprising:

a generally planar central portion having a first upstanding hook formation along a first side edge thereof and a second upstanding hook receiving formation along a second side edge thereof, said central portion together with said hook formation and said hook receiving formation defining a total sheet width, and said hook formation and said hook receiving formation both extending upwardly to a height which is a minimum of 10% of said total sheet width;

said first upstanding hook formation comprising a sloping first part (10) extending upwardly and outwardly from said central portion, a first wall (11) extending upwardly from said sloping part (10) at approximately a right angle to said central portion and having a height between 20% and 30% of the height of said first upstanding hook formation, said first wall (11) having thereon a first latching surface, a first flat (12) extending outwardly approximately at a right angle to said first wall (11), a second part (13) projecting downwardly and outwardly from said first flat, and a third part (14) projecting upwardly and inwardly from said second part (13), said second and third parts defining a hook;

a longitudinal portion of said sheet adjacent to said second side edge defining a valley area for receiving fastening means for fastening said sheet directly to a support underlying said sheet thereby avoiding the interposition of separate clips;

said second upstanding hook receiving formation being located inwardly of said valley area and comprising a generally vertical sidewall (21) parallel to said first wall (11), said vertical sidewall (21) having thereon a second latching surface, a platform (19) extending inwardly from said sidewall at approximately a right angle thereto, said platform (19) being generally co-planar with said first flat (12), a sloping third part (16) extending upwardly and outwardly from said central portion, a second wall (**16*b*) extending upwardly from said sloping third part (16) at approximately a right angle to said central portion, and a hook receiving part shaped to engage said hook and extending downwardly and inwardly from said platform (19) and an upper portion of said second wall (16*b***) shaped to engage said hook;

wherein said first upstanding hook formation and said second upstanding hook receiving formation being so configured that when an identical upstanding hook formation of a second metal sheet is interlocked with said second upstanding hook receiving formation, the hook formation of said second sheet engages said second upstanding hook receiving formation at a position (E) when the second sheet is disposed at angle (F) from the horizontal, and said initial latching of said first latching surface and said second latching surface commences during relative rotation at least 25° prior to said second sheet reaching a final latched position wherein said second sheet extends substantially co-planar with said sheet.

* * * * *